US009498008B2

(12) United States Patent
Murphy et al.

(10) Patent No.: US 9,498,008 B2
(45) Date of Patent: Nov. 22, 2016

(54) GARMENTS HAVING AN EVACUATION HARNESS AND METHODS OF USING THE SAME

(71) Applicant: Hyprum LLC, Lebanon, OH (US)

(72) Inventors: Robert K. Murphy, Ada, MI (US); Tom J. Africa, Lebanon, OH (US); Patrick R. Walker, Pataskala, OH (US)

(73) Assignee: Hyprum LLC, Lebanon, OH (US)

( * ) Notice: Subject to any disclaimer, the term of this patent is extended or adjusted under 35 U.S.C. 154(b) by 745 days.

(21) Appl. No.: 13/776,876

(22) Filed: Feb. 26, 2013

(65) Prior Publication Data

US 2014/0237698 A1 Aug. 28, 2014

(51) Int. Cl.
*A41D 13/00* (2006.01)

(52) U.S. Cl.
CPC ..... *A41D 13/0007* (2013.01)

(58) Field of Classification Search
CPC ..... A41D 31/0007; A62B 35/0018; A62B 35/0031; A62B 35/0037
See application file for complete search history.

(56) References Cited

U.S. PATENT DOCUMENTS 2,699,284 A 6/1952 Rose
2,979,153 A * 4/1961 Hoagland ..... A41D 13/0007 182/3
2,996,228 A 8/1961 Bauman
3,074,074 A * 1/1963 Lovering ..... A01M 31/00 182/3
3,973,643 A * 8/1976 Hutchinson ..... A62B 35/0006 182/3
4,211,218 A 7/1980 Kendrick
D270,585 S 9/1983 Viio
4,422,454 A 12/1983 English
4,449,253 A * 5/1984 Hettinger ..... A41D 13/0007 2/93
4,478,311 A 10/1984 Anderson
4,593,788 A 6/1986 Miller
4,682,671 A * 7/1987 Hengstenberger . A62B 35/0037 182/3
4,706,858 A 11/1987 Whatley
4,854,418 A 8/1989 Hengstenberger et al.
4,863,409 A 9/1989 Johnson et al.
5,027,833 A 7/1991 Calkin
5,080,191 A 1/1992 Sanchez
5,435,272 A 7/1995 Epstein
5,617,582 A 4/1997 Burwell
5,799,328 A * 9/1998 Harlem ..... A41D 13/1236 2/114
5,960,480 A * 10/1999 Neustater ..... A62B 35/04 182/3
5,970,517 A * 10/1999 Jordan ..... A41D 13/0007 182/3
6,101,631 A * 8/2000 Ferguson, Jr. ..... A41D 13/0007 182/3

(Continued)

OTHER PUBLICATIONS http://www.rescue-essentials.com/Combat_Rescue_Sling_C_R_S_p/50/0461.htm; (date available to public at least as early as Jan. 16, 2013).

(Continued)

*Primary Examiner* — Danny Worrell
(74) *Attorney, Agent, or Firm* — Cook Alex Ltd.

(57) ABSTRACT

Garments having an evacuation harness that are intended for connection to each other, with each garment having an outer wear unit including at least a torso portion and an evacuation harness that includes a torso strap system connected to the outer wear unit, a drag strap coupling connected to the torso strap system and extending rearward relative to the outer wear unit, and a drag strap connected at a first end to the torso strap system at a position above the drag strap coupling and the drag strap being selectively extendible rearward relative to the outer wear unit. Also disclosed are methods of connecting a rescuer wearing a garment having an evacuation harness to an individual wearing a similarly configured garment having an evacuation harness.

28 Claims, 9 Drawing Sheets

(56) References Cited

U.S. PATENT DOCUMENTS

| | | | | |
|---|---|---|---|---|
| 6,105,169 | A * | 8/2000 | Colorado | A41D 13/0007 182/6 |
| 6,122,778 | A | 9/2000 | Cohen | |
| 6,205,584 | B1 * | 3/2001 | Yocco | A41D 13/0007 182/3 |
| 6,256,789 | B1 * | 7/2001 | Young | A41D 13/0007 182/3 |
| 6,427,252 | B1 * | 8/2002 | Lewis | A41D 13/0007 182/3 |
| 6,637,547 | B1 | 10/2003 | Wydner | |
| 6,651,594 | B1 | 11/2003 | Bagwell | |
| 6,658,666 | B2 * | 12/2003 | Schweer | A41D 13/0007 182/3 |
| 6,662,372 | B2 * | 12/2003 | Lewis | A41D 13/0007 182/3 |
| 6,800,007 | B2 | 10/2004 | Calkin | |
| 6,892,395 | B2 * | 5/2005 | Schweer | A41D 13/0007 182/3 |
| 7,036,628 | B2 * | 5/2006 | Wilcox | A41D 13/0007 119/770 |
| 7,047,567 | B2 * | 5/2006 | Allen | A41D 13/0007 2/69 |
| 7,086,091 | B2 | 8/2006 | Jordan | |
| 7,356,850 | B2 | 4/2008 | Turcotte et al. | |
| 7,451,495 | B2 * | 11/2008 | Munn | A41D 13/0007 182/9 |
| 7,467,419 | B2 | 12/2008 | O'Neal et al. | |
| 7,774,878 | B1 | 8/2010 | Florea et al. | |
| 7,814,567 | B2 | 10/2010 | Dovner et al. | |
| 7,917,968 | B2 | 4/2011 | Roux | |
| 7,971,273 | B2 * | 7/2011 | Grilliot | A41D 13/0007 2/227 |
| 7,987,520 | B2 * | 8/2011 | Henriquez | F41C 33/046 2/69 |
| 8,015,619 | B2 | 9/2011 | McKay et al. | |
| 8,016,335 | B2 | 9/2011 | McKay | |
| 8,162,365 | B2 | 4/2012 | Escobar | |
| 8,256,020 | B2 | 9/2012 | Dovner et al. | |
| 8,375,467 | B2 * | 2/2013 | Real | A41D 13/0007 2/69 |
| 8,430,204 | B1 * | 4/2013 | Reynolds | A41D 13/0007 182/3 |
| 8,438,664 | B2 * | 5/2013 | Fee | A62B 1/16 2/69 |
| 8,990,971 | B2 * | 3/2015 | Carter | A45F 3/10 2/2.5 |
| 2007/0044197 | A1 * | 3/2007 | Turcotte | A41D 13/0007 2/69 |
| 2007/0199135 | A1 * | 8/2007 | Grilliot | A41D 13/0007 2/311 |
| 2009/0095232 | A1 | 4/2009 | McKay | |
| 2009/0127300 | A1 | 5/2009 | Straight | |
| 2011/0030118 | A1 * | 2/2011 | Pratchett | A41D 13/0007 2/81 |
| 2011/0284322 | A1 | 11/2011 | West | |
| 2011/0302685 | A1 * | 12/2011 | Fay, III | A62B 35/0012 2/69 |
| 2011/0302688 | A1 * | 12/2011 | Vieux | A62B 35/0031 2/69 |
| 2012/0023638 | A1 * | 2/2012 | Leicester | A41D 13/0007 2/79 |
| 2014/0237698 | A1 * | 8/2014 | Murphy | A41D 13/0007 2/69 |
| 2014/0325733 | A1 * | 11/2014 | Rae | A62B 35/0006 2/69 |
| 2015/0033458 | A1 * | 2/2015 | Theisen | A62B 35/0025 2/467 |
| 2015/0359272 | A1 * | 12/2015 | Murphy | A41D 13/0007 2/69 |

OTHER PUBLICATIONS http://www.rescue-essentials.com/Slishman_Rescue_Pack_w_Harness_p/slishman.htm; (date available to public at least as early as Jan. 16, 2013).

http://www.rescue-essentials.com/NAR_Dragon_Harness_p/50/0464-htm.; (date available to public at least as early as Jan. 16, 2013).

* cited by examiner

GARMENTS HAVING AN EVACUATION HARNESS AND METHODS OF USING THE SAME

FIELD OF THE DISCLOSURE

The present disclosure is directed to garments used for protection in inherently dangerous environments, such as body armor vests or protective coats, and more particularly to such garments that include an evacuation harness and to methods of using the same.

BACKGROUND

Many individuals are faced with inherently dangerous situations and circumstances as part of their service in a military, law enforcement or firefighting position, or the like. Such individuals not only are susceptible to encountering situations where they may be seriously injured, incapacitated or rendered unconscious, but also are susceptible to being the one person present when a fellow professional falls victim to such misfortune and is in need of immediate evacuation from such a setting.

There are prior art devices that have been used to evacuate or extract an injured, incapacitated or unconscious individual from a dangerous situation. Such devices typically include a separate tow or drag line, or a strap, that is carried by a rescuer and can be connected at a first end to the individual to be extracted or to a sheet, sled or other object on which the individual may be lying, and then grasped by or connected to a rescuer at a second end.

Unfortunately, in many situations, there is no sled or other device available, and there is insufficient time or freedom to manipulate a harness that would have to be separately carried and then donned by the injured individual and/or the rescuer. Existing devices are not configured for both an injured individual and a rescuer to be wearing the same garment and to have the garments work in cooperation with each other to assist in an extraction. Moreover, it is common for devices to include a single means by which to connect to or grasp the individual, which may not be convenient to the rescuer or provide an advantageous position for the rescuer to pull or tow the individual to safety. When including a tow or drag line, the devices also typically include a single line or strap that will not prevent the individual being dragged from twisting or rotating to a position on a side or face down, which may inflict additional injuries. The devices also commonly lack structure to support the individual in such a manner that, if the individual is conscious and coherent, the individual may observe and communicate with the rescuer with respect to the setting behind them. At present, there remains a need for improvements in devices for use by a rescuer to evacuate or extract an individual from a dangerous situation.

SUMMARY

The present disclosure includes example devices that are garments, with each garment having an evacuation harness that is connected to the garment. The garment and harness are constructed for universal use, in the sense that the same device is to be worn by all personnel, and will be appropriate to permit extraction of the individual, as well as be appropriate to allow the rescuer to achieve the extraction of the individual. In this way, two like garments form a rescue garment system. The garments have an evacuation harness and may include multiple structures that permit the rescuer to utilize a plurality of configurations to tow or drag the individual, depending on the immediacy required, the availability of time and space to deploy certain advantageous structures of the device, the strength of the rescuer, and the position the rescuer may be able to assume while evacuating the individual.

In a first aspect, the present disclosure relates to a garment having an evacuation harness that includes an outer wear unit having at least a torso portion, and an evacuation harness that includes a torso strap system connected to the outer wear unit, a drag strap coupling connected to the torso strap system and extending rearward relative to the outer wear unit, and a drag strap connected at a first end to the torso strap system at a position above the drag strap coupling and the drag strap being selectively extendible rearward relative to the outer wear unit.

In another aspect, the present disclosure relates to a garment having an evacuation harness that includes an outer wear unit having at least a torso portion, and an evacuation harness that includes a torso strap system connected to the outer wear unit, a drag strap coupling connected to the torso strap system and extending rearward relative to the outer wear unit, a drag strap connected to the torso strap system at a position above the drag strap coupling and being selectively extendible rearward from the outer wear unit, and at least two auxiliary straps connected to the torso strap system and being selectively extendible from the outer wear unit.

In a further aspect, the present disclosure relates to a rescue garment system having at least two similarly configured garments, each of the garments further having an outer wear unit including at least a torso portion, and an evacuation harness that includes a torso strap system connected to the outer wear unit, a drag strap coupling connected to the torso strap system and extending rearward relative to the outer wear unit, and a drag strap connected at a first end to the torso strap system at a position above the drag strap coupling and the drag strap being selectively extendible rearward relative to the outer wear unit, and wherein the drag strap of one of the respective at least two garments is configured to be removably connected to the drag strap coupling of the other of the respective at least two garments.

In yet another aspect, the present disclosure relates to a method of connecting a rescuer wearing a garment having an evacuation harness to an individual wearing a similarly configured garment having an evacuation harness, wherein each garment having an evacuation harness includes an outer wear unit and an evacuation harness that has a torso strap system connected to the outer wear unit, a drag strap coupling connected to the torso strap system and extending rearward relative to the outer wear unit, and a drag strap connected to the torso strap system and being selectively extendible rearward relative to the outer wear unit. The method further includes the steps of extending from the garment of the individual the drag strap in a direction rearward relative to the individual, and connecting the drag strap on the garment of the individual to the drag strap coupling on the garment of the rescuer that extends in a direction rearward relative to the rescuer, wherein the individual faces substantially opposite to a direction of travel of the rescuer.

Garments including an evacuation harness consistent with the present disclosure provide convenient, compact, easy to use devices that can be conveniently and unobtrusively carried by all personnel, rapidly deployed without the use of tools, and provide a plurality of advantageous configurations to permit the rescuer to effectively immediately choose an appropriate configuration for the circumstances, and to thereafter utilize a more advantageous configuration, if provided an opportunity to do so. The devices provide an immediate solution for the individual and the rescuer when faced with what could be a grave situation. The connection of the rescuer to the individual also advantageously may permit hands-free pulling by the rescuer, which may permit both the rescuer and the individual being rescued to participate in protecting themselves or others, such as by continuing to be able to operate a weapon, a fire extinguisher or other safety equipment.

The evacuation harness includes a torso strap system that is connected to the outer wear unit, while allowing selectively extendible portions to be conveniently and efficiently stowed and ready for immediate use. It will be appreciated that the torso strap system may be connected to the outer wear unit in various ways, which may include integrating the harness into a garment, such as by having it sewn or otherwise connected within the outer wear unit, whether by sewing it directly to an inner side of the outer wear unit or by locating it between a lining and the outer wear unit. When located within the outer wear unit, portions of the evacuation harness may be stowed within the outer wear unit and may be selectively extendible through apertures in the outer wear unit. Releasable flaps or other coverings and/or zippers or other closures may be used to help retain the portions of the harness that are stowed during normal use of the garment. The torso strap system also could be connected to the outer wear unit by being sewn or otherwise connected to an outer side of the outer wear unit. In such instances, the selectively extendible portions of the harness may include temporary holding structures, such as hook and loop fasteners, snaps or the like, to hold the extendible portions adjacent to the garment when not deployed.

It also will be appreciated that the devices may be embodied in protective garments worn by personnel serving in various different capacities. Thus, the garments may be constructed, for example, to be worn by soldiers or police personnel in the form of armored vests, while those worn by firefighters may be constructed in the form of fireproof coats or the like. Such garments may be stocked and provided by the military, or first responder and other emergency organizations for use in situations when weaponry has been or may be utilized, or when fire, natural disasters or other events pose a threat of injury or loss of life to personnel. Whether provided by a governmental or private entity, the ability to conveniently and seamlessly carry a universal evacuation device within a garment that already will be worn by all personnel and that is configured to be complementary to and used with a similar garment may provide some valuable peace of mind to those who know their service may result in serious injury that could require rapid evacuation of personnel.

BRIEF DESCRIPTION OF THE DRAWINGS

The above-mentioned and other features of the present disclosure, and the manner of attaining them, will become more apparent and will be better understood by reference to the following description of exemplary embodiments of the present disclosure, taken in conjunction with the accompanying drawings, wherein.

Figure 1:
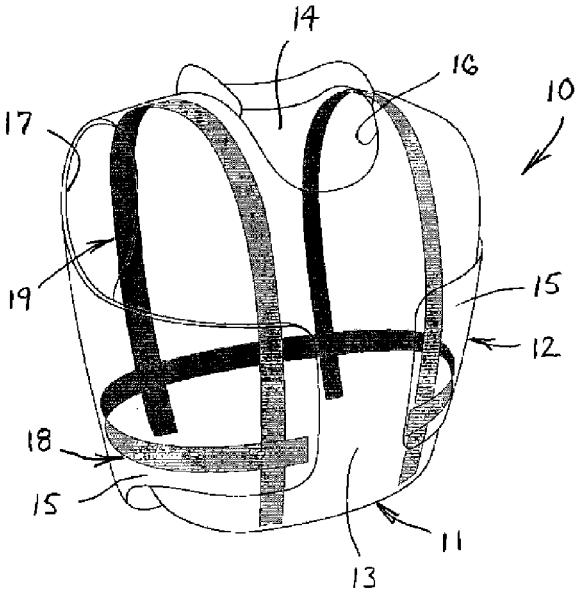
FIG. 1 is a front perspective view of a garment that includes an outer wear unit and an evacuation harness and is shown in a closed position, as it would be worn.
Figure 2:
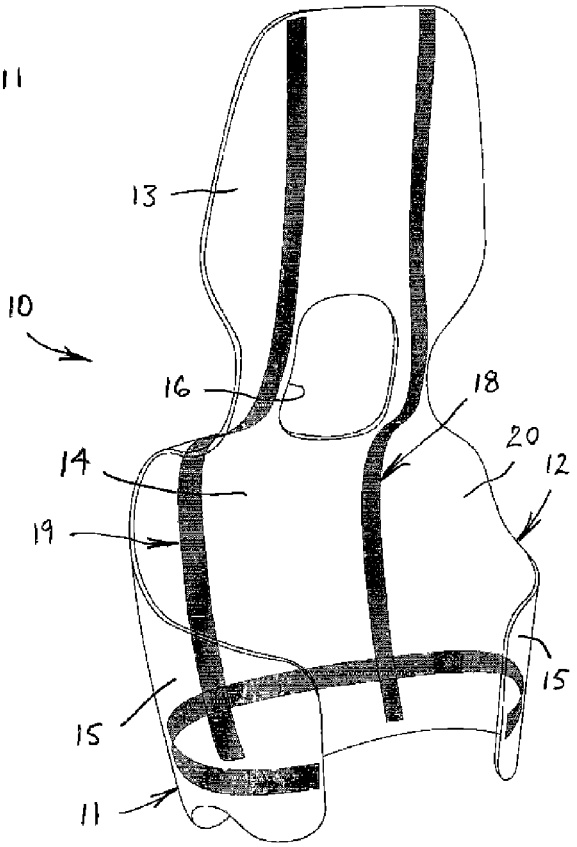
FIG. 2 is a front perspective view of the garment of FIG. 1 in an open position, prior to donning.
Figure 3:
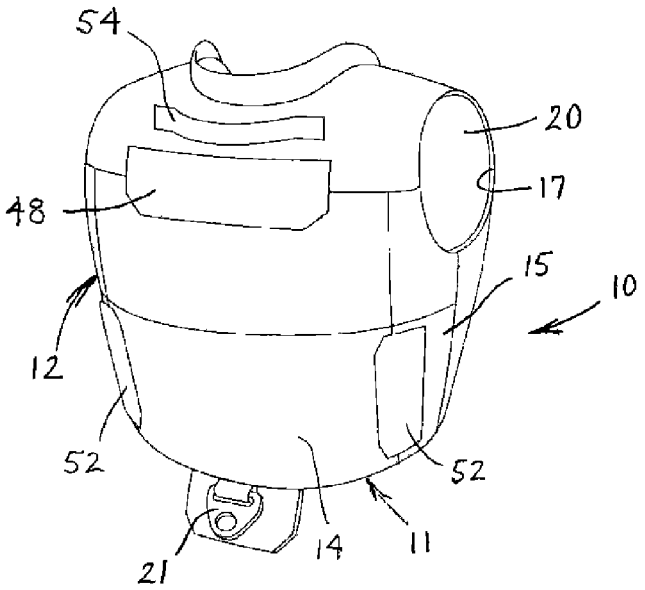
FIG. 3 is a rear perspective view of the garment of FIGS. 1 and 2, showing a drag strap coupling extending rearward relative to the outer wear unit.

Corresponding or related reference numerals indicate corresponding parts throughout the several views. Although the drawings represent exemplary embodiments of the present disclosure, the drawings are not necessarily to scale and certain features may be exaggerated, removed or shown in phantom to better illustrate and explain the present disclosure.

DETAILED DESCRIPTION

Examples of the present subject matter are disclosed herein. However, it will be understood that the disclosed examples merely are exemplary, and that garments within the scope of the appended claims may be embodied and constructed in various forms. Therefore, specific details disclosed herein are not to be interpreted as limiting, but as illustrative of various aspects of the present subject matter.

As described in more detail herein, the present disclosure is directed to garments having an evacuation harness, such as may be utilized by military personnel or first responders in instances that present clear and present dangers that may cause an individual to be injured, incapacitated or rendered unconscious, and methods of using such garments. In general, garments having an evacuation harness of the present disclosure are intended to be worn by all personnel that will be present in an inherently dangerous setting, such that a rescuer will be wearing a garment that is similarly configured to a garment that may be worn by an individual that is in need of assistance and evacuation from a dangerous situation. This common or universal use of a similar garment among personnel removes the doubt or hesitation that can arise with respect to prior art systems when trying to determine what means and capacity a rescuer may have to extricate an injured individual.

FIGS. 1-10 show an example garment 10 having an outer wear unit 11 that includes at least a torso portion 12 that may be donned and worn about the torso of a person. While other configurations for vests, coats or other outer wear units may be used, depending on the configuration chosen, as in the present example, the outer wear unit 11 may include a front portion 13, a rear portion 14, side portions 15, a neck hole 16, and arm holes 17. It will be appreciated that the neck and arm holes may be formed into the outer wear unit, as with the neck hole 16 of this example, or formed in conjunction with overlapping panels when donning the outer wear unit, as with the arm holes 17 of this example. The different portions of the vest may be connected together or selectively connected to each other by use of conventional fastening means, such as hook and loop fasteners, releasable buckles, snaps or the like. The example garment 10 is constructed in the form of body armor or a ballistic vest, such as may be worn by military or law enforcement personnel. The construction of the outer wear unit 11 may include suitable materials to accomplish the intended purpose. For instance, among other materials, a body armor vest may include any one of several bullet resistant woven fabrics, such as Kevlar®, and may enclose or cover metal or ceramic bulletproof plates. However, it should be noted that the garments may be constructed for various other purposes, such as, for example, in the form of a fire coat, which may include fireproof materials.

The garment 10 also includes an evacuation harness 18. The evacuation harness 18 has a torso strap system 19 that is connected to the outer wear unit 11. It should be noted that the term torso strap system is being used to mean a construction that includes a group of flexible, relatively high strength elements, such as woven straps, rope or other lines that are connected together in a configuration to generally surround the torso of an individual, and may include other molded integrally formed webbing structures. Thus, in the present disclosure, the term strap should be understood to mean a flexible element, and need not be relatively wide and thin. The construction of the evacuation harness 18 may include suitable relatively light weight, strong and flexible materials, such as Kevlar®, Nylon, plastics or the like. In addition, the evacuation harness 18 may be connected to the outer wear unit 11 in a variety of ways, such as by being sewn or snapped to an inner and/or an outer side of the outer wear unit 11, or located between an inner liner 20, made of a suitable material, and the outer wear unit 11.

Connected to the torso strap system 19 of the evacuation harness 18 is a drag strap coupling 21 that extends rearward relative to the outer wear unit 11. In this example, the drag strap coupling 21 is located so as to be proximate the tailbone of the garment wearer and includes a connector in the form of a ring or plate having an aperture. The drag strap coupling 21 of this example is connected to the torso strap system 19 in a manner that permits some freedom of movement, such as to accommodate forces on the drag strap coupling 21 that may tend to cause pivoting and/or twisting. It will be appreciated that the drag strap coupling may have a different location and/or configuration, such as, for instance, being formed as a part of a flexible element of the torso strap system, or as including a plurality rings or plates, or apertures within a plate. When the drag strap coupling is of a more rigid construction, such as the plate in the present example, then the drag strap coupling may be constructed of aluminum, titanium, steel or other metal alloys, or of composite or plastic materials or the like.

On the rear portion 14 of the outer wear unit 11, preferably positioned above the drag strap coupling 21, is a drag strap 22 that has a first end 24 connected to the torso strap system 19. The drag strap 22 is selectively extendible rearward relative to the outer wear unit 11 and terminates in a second end 25 that includes a connector 26 that is intended to be connectable to a drag strap coupling 21 on a similarly configured garment. In this example, the connector 26 is a releasable connector, such as in the form of a carabiner or clasp that is releasably connectable to a drag strap coupling on a similarly configured garment. The connector 26 may be constructed of materials similar to those mentioned above with respect to the drag strap coupling. The drag strap 22 includes flexible, high strength elements, such as woven straps, rope or other lines, and is shown in this example as including longitudinal strap members 27 and lateral strap members 28 that are connected together to form an advantageous web or ladder-type structure that provides a head support portion 29 for the individual being evacuated. Thus, the head support portion 29 is available to help support and stabilize the head of an individual that leans back into the drag strap 22 while being rescued.

The drag strap 22 also may include further connectors 30, or selected locations along the strap structure where a connector may be looped around a strap or through an aperture in a strap, to permit additional advantageous connections to a similarly configured garment, as will be discussed herein. When the connectors 30 are of a more rigid construction, they may be made of materials similar to those mentioned above with respect to the drag strap coupling. Also, it will be appreciated that any of the structures utilized for the drag strap coupling and the connectors on the drag strap may be of a fixed configuration, such as a continuous ring or strap, or of a releasable construction, such as a carabiner or clasp, as long as such structures are used in a complementary manner to permit releasable connection between mating structures of two similarly configured garments. Thus, at least one of a mating or complementary set of connectors should have a releasable configuration, and preferably is designed for quick and easy attachment and detachment.

The evacuation harness 18 of this example further includes at least two auxiliary straps 32 that are selectively extendible from the outer wear unit 11. The auxiliary straps 32 are laterally spaced apart and each auxiliary strap 32 of this example has a first segment 34 that is connected at a first end 36 to the torso strap system 19 and at a second end 38 that includes a connector 40. In the example shown, the connectors 40 are releasable connectors, such as a carabiner or a clasp for connection to a respective connector 30 on a drag strap 22 of a similarly configured garment 10. If of rigid construction, such as in the example shown, the connectors 40 may be made of materials similar to those mentioned above with respect to the drag strap coupling. However, as noted above, at least one of the complementary connectors should be of a releasable configuration to permit the connecting and disconnecting of the similarly configured garments in a quick and easy manner, and one or more of the complementary connectors could be of a flexible construction, such as being a portion of a respective strap. It will be appreciated that the auxiliary connections of respective connectors 30, 40 may provide for enhanced stability of the connection between the two garments. Such connections may help keep an individual being evacuated in an upright orientation, by resisting the potential rolling or twisting of the drag strap that would occur if such an individual were to roll or turn over relative to the ground surface while being dragged. Thus, this advantageous feature may reduce the likelihood of incurring further injuries during an evacuation.

Each auxiliary strap 32 of this example also includes a second segment 42 that is connected to the second end 38 of the first segment 34, and that is releasably connected to the first segment 34 along its length, such as by use of hook and loop fastener portions, snaps or other suitable releasable fastening structures. The second segments 42 are shown connected along their length to the first segments 34 in FIGS. 7, 8 and 10, and are shown separated along their length in FIG. 9.

Each second segment 42 of an auxiliary strap 32 further includes a grasping portion 44 at a second end. The grasping portion 44 preferably is configured for easy and secure engagement and disengagement by a hand of a rescuer wearing a garment 10, and thus may be configured with a loop, knot or other suitable integrally formed or added handle. The auxiliary straps 32 may be constructed to provide for quick and easy separation of the first and second segments 34, 42 upon simply pulling the grasping portion 44 in a direction away from the first end 36 of an auxiliary strap 32.

As will be discussed further herein, with the connectors 40 of the auxiliary straps 32 on a garment 10 worn by a rescuer being connected to the connectors 30 on the drag strap 22 of an individual being evacuated, the rescuer may pull the grasping portions 44 upward and over the top of the rescuer's shoulders to partially lift the individual being evacuated. Such a partially lifted position may advantageously permit the individual to be dragged without having the torso seated on a ground surface. This may reduce the likelihood of injuries that could occur during a rapid seated extrication over rough or uneven surfaces. The garment 10 also may include one or more connectors positioned on the front of the torso portion and to which the grasping portions 44 may be releasably connected. Such further connection of the grasping portions 44 may permit the rescuer to continue to partially suspend the individual being evacuated, while providing the highly useful benefit of returning to hands-free connection of the respective garments. The hands free evacuation afforded by use of the present garment 10 provides the strategic advantage of permitting the rescuer to handle a weapon or safety equipment, or to otherwise use the hands for enhanced balance and to generate added climbing and/or pulling power.

In the example shown in FIGS. 1-10, the garment 10 is constructed with the torso strap system 19 being located inside of the outer wear unit 11, but hidden from view by the inner liner 20. This construction permits the use of pouches within the outer wear unit 11, so that the drag strap 22 and auxiliary straps 32 are stowable within the outer wear unit 11 when not in use. Flaps or other closures also may be used on the rear portion 14 or side portions 15 of the outer wear unit 11 to releasably cover apertures through which the straps are selectively extendible. The facility to stow the straps helps prevent the straps from snagging on objects when not deployed. Releasable flaps may be held in a closed position by use of suitable fasteners, such as hook and loop material, snaps or the like.

Figure 4:
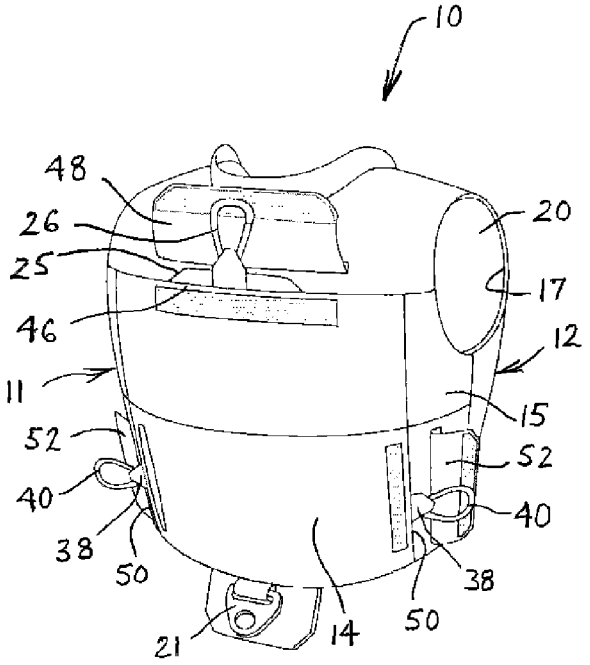
FIG. 4 is a rear perspective view of the garment of FIGS. 1-3, showing flaps in an open position and revealing an end of a drag strap and ends of auxiliary straps.
Figure 5:
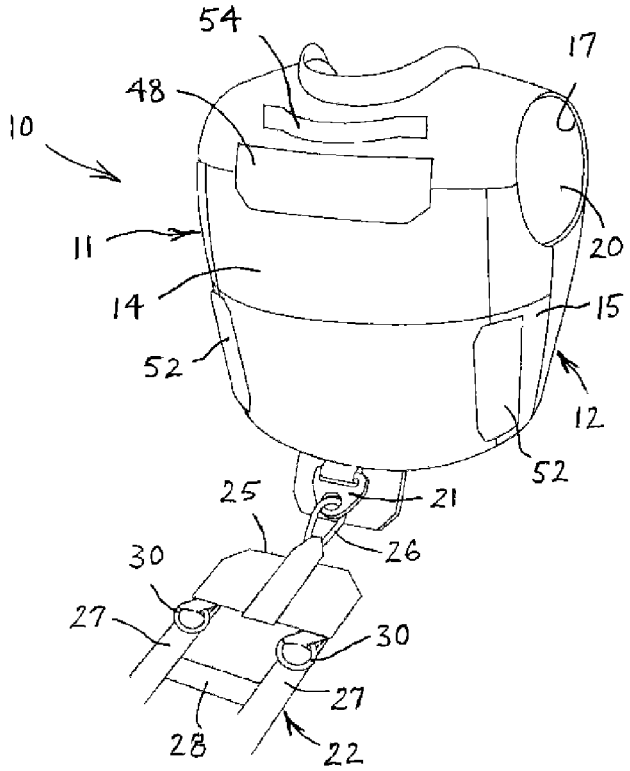
FIG. 5 is a rear perspective view of the garment of FIGS. 1-4, showing a drag strap coupling extending rearward relative to the outer wear unit and an end of a drag strap of a similarly configured garment connected thereto.
Figure 6:
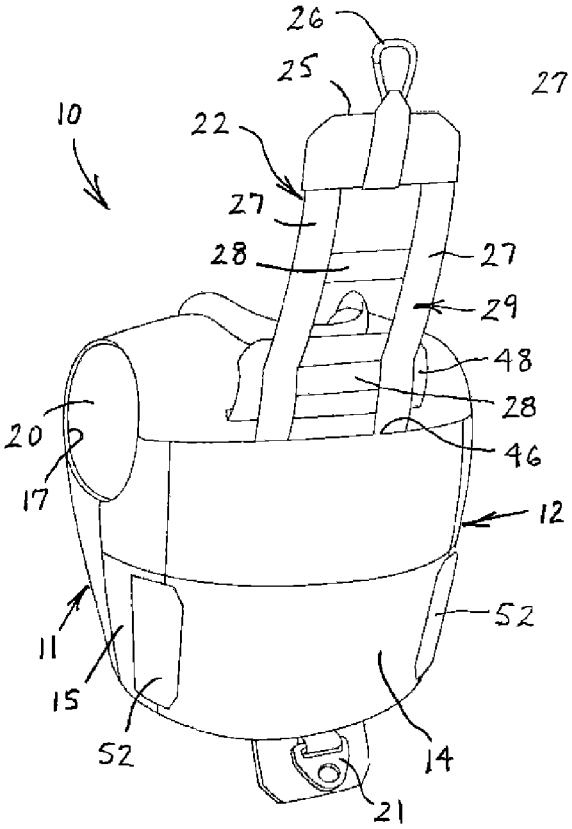
FIG. 6 is a rear perspective view of the garment of FIGS. 1-4, showing a drag strap extending rearward relative to the outer wear unit.
Figure 7:
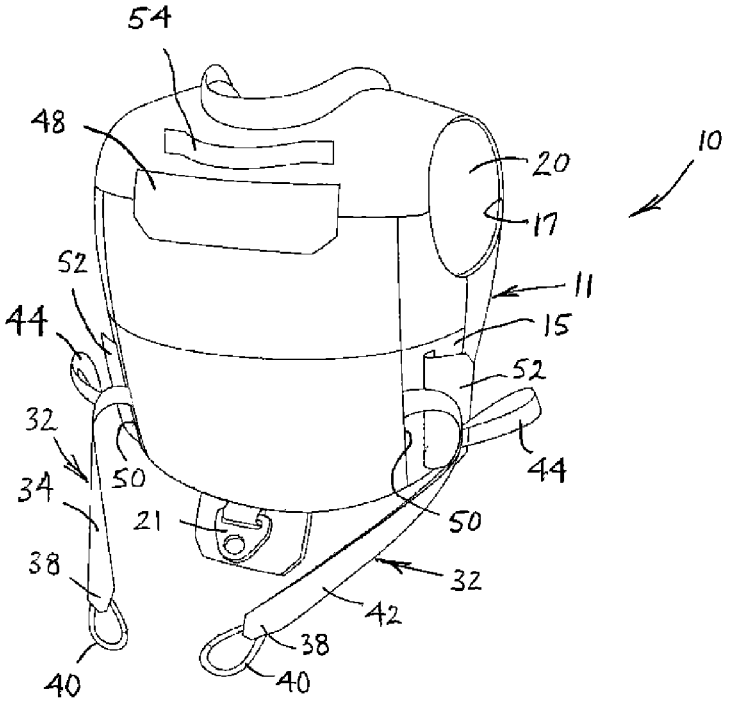
FIG. 7 is a rear perspective view of the garment of FIGS. 1-4, showing a drag strap coupling extending rearward relative to the outer wear unit, as well as auxiliary straps extending from the outer wear unit.
Figure 8:
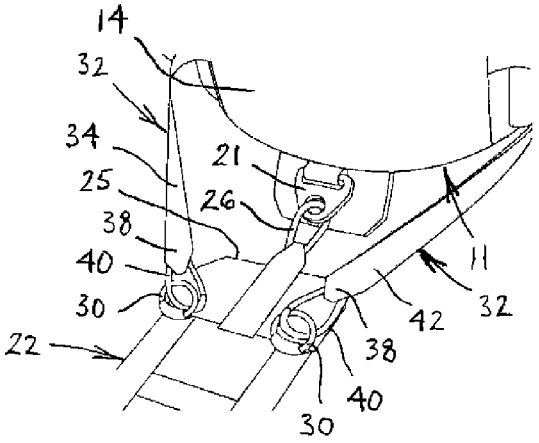
FIG. 8 is a rear perspective view of a portion of the garment of FIGS. 1-4, showing a drag strap coupling and auxiliary straps extending rearward relative to the outer wear unit and being connected to a drag strap of a similarly configured garment.
Figure 9:
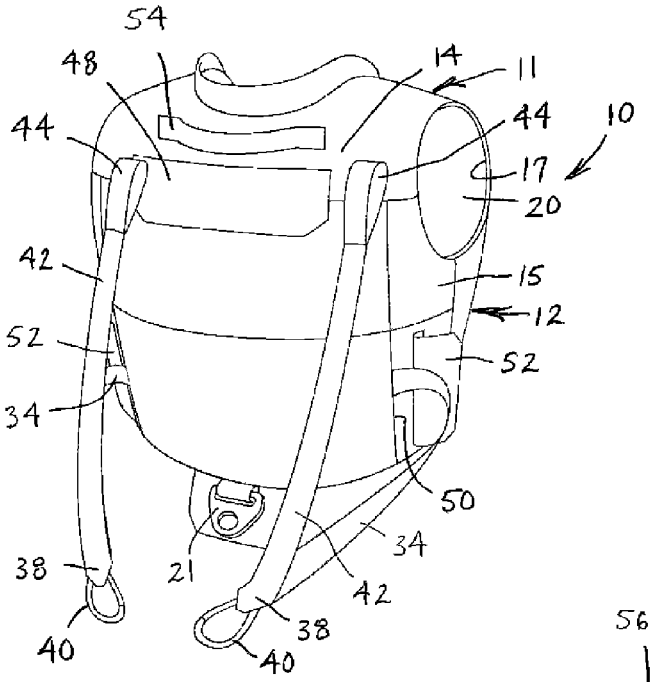
FIG. 9 is a rear perspective view of the garment of FIGS. 1-4, showing the auxiliary straps having second segments that are connected to first segments, but separated therefrom along their lengths.
Figure 10:
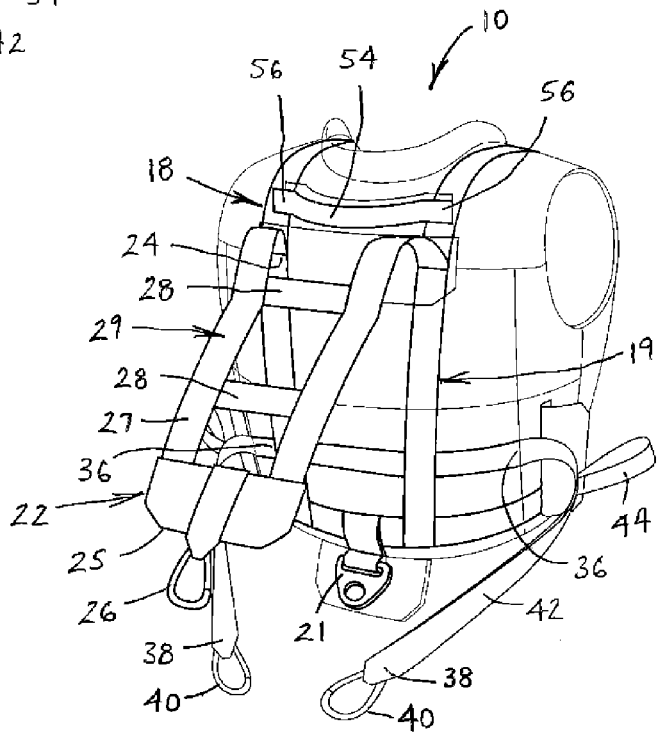
FIG. 10 is rear perspective view of the garment of FIGS. 1-4, showing the outer wear unit in lighter phantom lines and showing the evacuation harness in heavier solid lines with the drag strap coupling, drag strap, and auxiliary straps extending from the outer wear unit.

In the present example, the outer wear unit 11 includes an aperture 46 by which one can reach in and retrieve the stowed drag strap 22 to selectively extend the drag strap 22 rearward relative to the outer wear unit 12. The aperture is releasably covered by a flap 48 that is located on the rear portion 14 of the outer wear unit 11. This can be appreciated when comparing FIGS. 3, 4 and 6, which show the garment 10 with the drag strap 22 in various positions. For instance, in FIG. 3, the drag strap 22 is concealed while being stowed within the outer wear unit and the flap 48 is closed. In FIG. 4, the flap 48 is open and the second end 25 of the drag strap 22, as well as the connector 26, are extending from the aperture 46. Then, in FIG. 6, the drag strap 22 has been further extended through the aperture 46 rearward relative to the outer wear unit 12.

With respect to each of the auxiliary straps 32, the outer wear unit 11 includes an aperture 50 by which one can reach in and retrieve the stowed auxiliary strap 32 to selectively extend the auxiliary strap 32 from the outer wear unit 11. Each aperture 50 is releasably covered by a flap 52 that is located on a side portion 15 of the outer wear unit 11. This can be appreciated when comparing FIGS. 3, 4 and 7, which show the garment 10 with the auxiliary straps 32 in various positions. For instance, in FIG. 3, the auxiliary straps 32 are concealed while being stowed within the outer wear unit and each flap 52 is closed. In FIG. 4, each flap 52 is open and the second end 38 of the first segment 34 of the auxiliary straps 32 with the connectors 40 are extending from the apertures 50. Then, in FIG. 7, the auxiliary straps 32 have been further extended through the apertures 50 from the outer wear unit 12. It will be understood that the auxiliary straps could extend from the sides, rear or front of the outer wear unit, and from any position vertically between the bottom edge of the garment and the shoulders, depending on the desired configurations for connection of a first garment to a similar second garment. Also, it will be understood that for increased stability or lifting configurations, the rescue garment system of similar garments may utilize the connection of auxiliary straps extending from the rescuer's garment to the individual's garment or from the individual's garment to the garment of the rescuer.

The garment 10 of this example also includes a handle 54, which is connected to the torso strap system 19. The handle 54 is positioned above the drag strap 22, near the top of the rear portion 14 of the outer wear unit 11, and is connected to the torso strap system 19 at two spaced apart positions 56. As noted below, the handle 54 may be used when there is insufficient opportunity to connect the drag strap 22 on the garment 10 of an individual being evacuated to the drag strap coupling 21 on the garment 10 of a rescuer.

Upon reviewing FIGS. 11-14, it will be appreciated that the present garment 10 with an evacuation harness 18 provides unique advantages when a rescuer is faced with trying to evacuate an injured, incapacitated or unconscious individual wearing a similarly configured garment 10 from a dangerous situation. The garments represent a rescue garment system that includes at least two similarly configured garments 10, with each of the garments 10 having an outer wear unit 11 including at least a torso portion 12 and an evacuation harness 18. The evacuation harness 18 includes a torso strap system 19 connected to the outer wear unit 11, a drag strap coupling 21 connected to the torso strap system 19 and extending rearward relative to the outer wear unit 11, and a drag strap 22 connected at a first end 24 to the torso strap system 19 at a position above the drag strap coupling 21 and the drag strap 22 being selectively extendible rearward relative to the outer wear unit 11, wherein the drag strap 22 of one of the respective at least two garments 10 is configured to be removably connected to the drag strap coupling 21 of the other of the respective at least two garments 10.

FIGS. 11-14 will be described with reference to circumstances that may be faced by military or law enforcement personnel. A garment 10 is worn by each of a rescuer and an individual that needs to be extricated, with each garment 10 incorporating built-in hardware or appliances that permit the rescuer to rapidly choose and deploy the appropriate means for the given situation. Indeed, the common construction among the garments 10 worn by the two persons and the ease with which one can feel for, deploy and connect the appropriate straps and connectors likely permits a rescuer to complete an appropriate connection of the two garments without having to look at the components. This, along with the goal of getting the rescuer to hands-free operation as soon as practicable, provide unique advantages over prior art devices that must be separately carried and that require unwinding and particular positioning to don a harness and/or to apply a harness to the injured individual.

Figure 11:
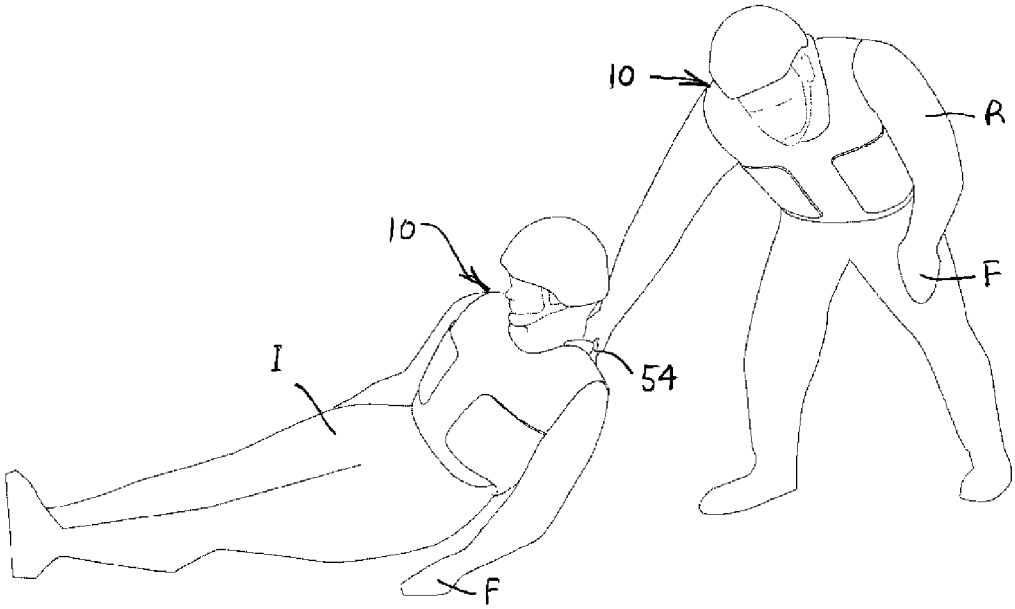
FIG. 11 is a simplified view of a rescuer wearing a garment of FIGS. 1-4 and grasping a handle on a similarly configured garment worn by an individual seated on a ground surface.

In FIG. 11, a rescuer R is faced with the need for immediate removal of an injured individual I, such as when soldiers are under fire. In such an instance, the rescuer R may immediately grasp the handle 54 on the upper rear portion of the outer wear unit 11 of the individual I with one hand, while still being able to stay relatively low and hold a weapon or otherwise use a free hand F in attempting to drag the evacuee to less dangerous surroundings, whether in an upward or downward facing position.

Figure 12:
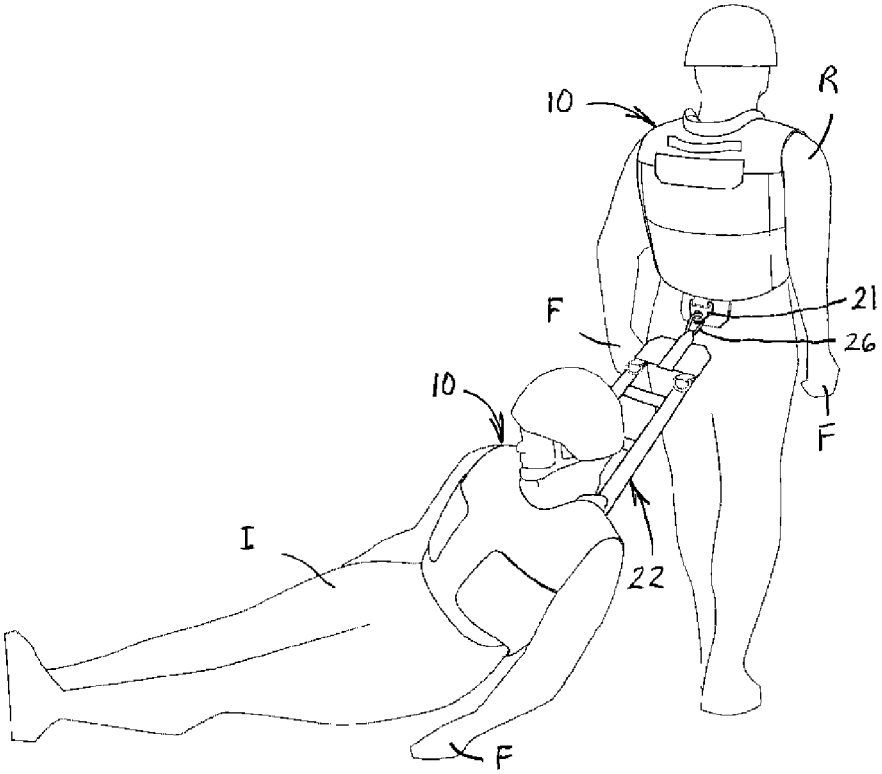
FIG. 12 is a simplified view of a rescuer wearing a garment of FIGS. 1-4 that has a drag strap coupling connected to a drag strap on a similarly configured garment worn by an individual seated on a ground surface.

In FIG. 12, preferably once removed from open fire, but still in a highly dangerous setting, the rescuer R may extend from the garment 10 of the individual I the drag strap 22 in a direction rearward relative to the individual I. The rescuer R then may continue by connecting the drag strap 22 on the garment 10 of the individual I to the drag strap coupling 21 on the garment 10 of the rescuer R that extends in a direction rearward relative to the rescuer R. In this configuration, the individual I will be facing substantially opposite to a direction of travel of the rescuer R. To accomplish this with the garments 10 shown requires extending the drag strap 22 from a stowed position through an aperture 46 in the outer wear unit 11 of the garment 10 of the individual I, before connecting the drag strap 22 to the drag strap coupling 21 on the garment 10 of the rescuer R.

This advantageous arrangement permits fast mobility and completely hands-free evacuation for both the rescuer R and the individual I. This further allows both persons to be in a position to operate a weapon, safety equipment or to communicate with others, depending on their condition and the circumstances. Indeed, the web or ladder-type structure of the head support portion 29 also helps support and stabilize the head of an individual I as the individual leans back into the drag strap 22. Once again, the deployment of the drag strap 22 from the individual's garment and the connection to the drag strap coupling 21 on the rescuer's garment, as with the aforementioned grasping of the handle 54, likely could be quickly and securely accomplished in a dark setting or otherwise without having the opportunity to view the components being manipulated. In this sense, the operation also may be considered to be eyes-free, which may provide a further significant advantage in the heat of the moment.

Figure 13:
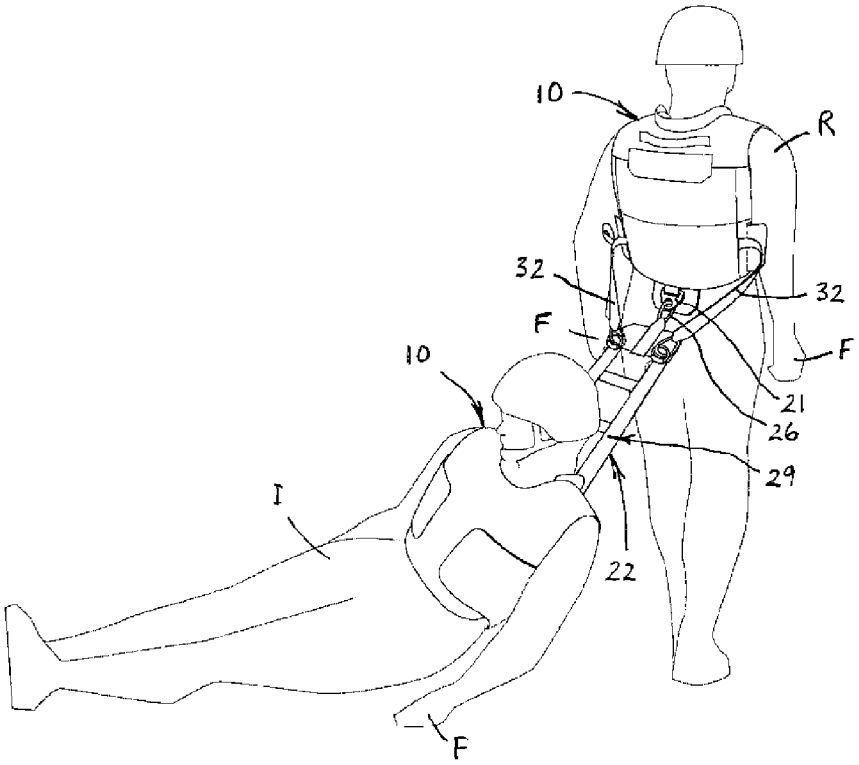
FIG. 13 is a simplified view of a rescuer wearing a garment of FIGS. 1-4 that has a drag strap coupling and auxiliary straps connected to a drag strap on a similarly configured garment worn by an individual seated on a ground surface.

FIG. 13 illustrates yet another mode available for use by the rescuer R, which is more likely to be utilized once the rescuer R is removed from the immediate combat area or if the rescuer R has slightly more time available when initially connecting the respective garments. This mode permits more stable mobility and was discussed above with respect to instances when connectors 30 on a drag strap 22 of a garment 10 that is worn by an individual I are connected to connectors 40 on auxiliary straps 32 of a garment 10 that is worn by a rescuer R. This mode requires providing for each of the respective garments 10 at least two of the aforementioned auxiliary straps 32 that are connected to the torso strap system 19 of the respective garments, and connecting the auxiliary straps on the garment 10 of the rescuer R to the drag strap 22 on the garment 10 of the individual I. The connection may be made by connecting the connectors 40 on the auxiliary straps 32 to the connectors 30 on the drag strap 22. Employment of this configuration will help keep the individual I more stable and less prone to rolling during evacuation. This may further complement the support and stability provided for the head of the individual I by the aforementioned head support portion 29 of the drag strap 22.

Figure 14:
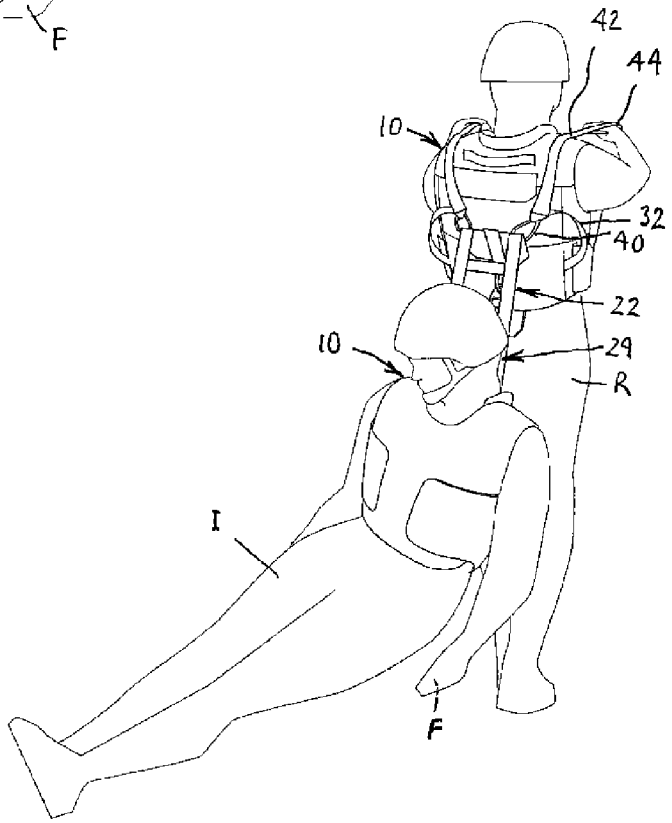
FIG. 14 is a simplified view of a rescuer wearing a garment of FIGS. 1-4 that has a drag strap coupling and auxiliary straps connected to a drag strap on a similarly configured garment worn by an individual seated on a ground surface, and further having the rescuer grasping second segments that extend from first segments of the auxiliary straps, permitting the rescuer to partially lift the individual off of a ground surface.

Turning to FIG. 14, a further mode of evacuation with the device disclosed herein is presented. In this mode, the rescuer R is able to hoist or partially lift the individual I off of the ground surface, to significantly reduce the drag effects on the individual I. This mode provides for increased mobile comfort and reduced likelihood of injury to the individual I from contact with the ground surface. To achieve this mode with use of the example garments 10, the auxiliary straps 32 include a first segment 34 that extends between the torso strap system 19 on the garment 10 of the rescuer R and the drag strap 22 on the garment 10 of the individual I, as well as a second segment 42 that has a first end connected to the first segment 34 and that is further releasably connected along its length to the first segment 34. So equipped, the rescuer R must then act to release along their length the connection between the respective first and second segments 34, 42 of each auxiliary strap 32 on the garment of the rescuer R, while maintaining the connection of the first end of the second segment 42 to the first segment 34. This can be accomplished by having the rescuer R grasp and pull a second end of each respective second segment 42 of the auxiliary straps 32 on the garment 10 of the rescuer R. After separation along the length of the first and second segments 34, 42, continued pulling of the second segments 42 up and over the shoulders of the Rescuer R results in the rescuer R partially lifting the individual I, for more comfortable transport. The first and second segments 34, 42 are shown connected to each other at the second end 38 of the first segment 34. Also, the grasping of the second end of each second segment 42 is facilitated by including an above-discussed grasping portion 44.

FIG. 14 shows the rescuer R having lifted the torso or a portion of the individual I partially off the ground surface. As noted above, to return to hands-free evacuation, the rescuer R could connect the grasping portions 44 at the second ends of the second segments 42 to optional connectors on the front of the garment 10.

Figure 15:
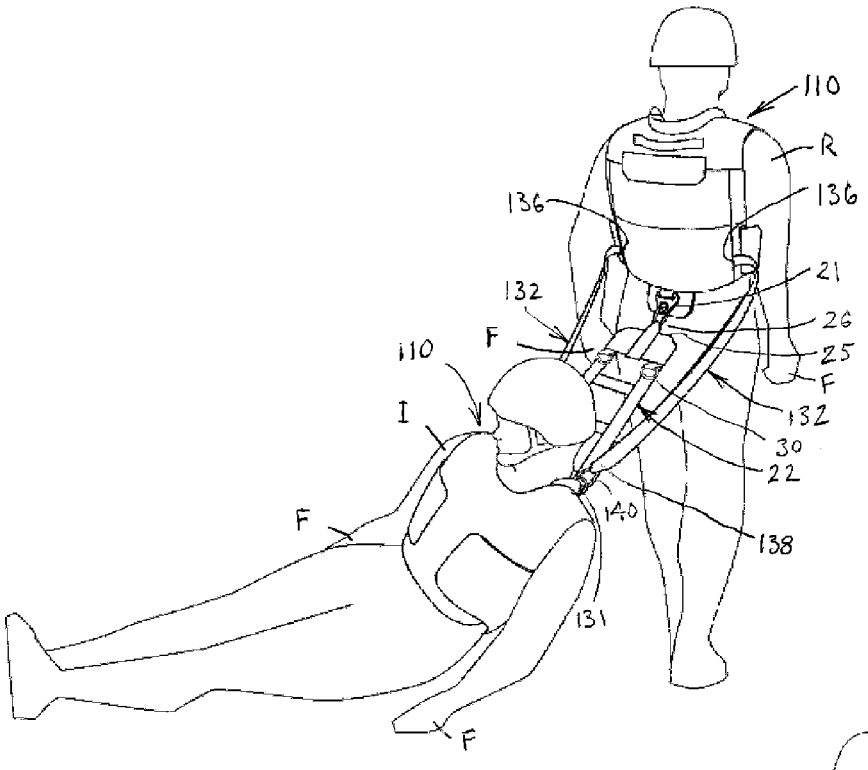
FIG. 15 is a simplified view of a rescuer wearing a second example garment that has a drag strap coupling connected to a second end of a drag strap on a similarly configured garment worn by an individual seated on a ground surface, as well as auxiliary straps on the garment of a rescuer that are connected to a first end of the drag strap on the garment worn by the seated individual.
Figure 16:
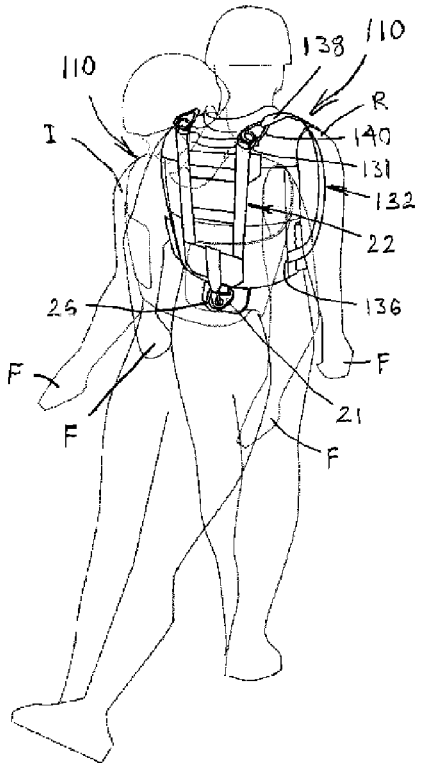
FIG. 16 is a simplified view of the second example garments of FIG. 15 with the auxiliary straps on the garment of the rescuer extending forward and then over the shoulders of the rescuer and rearward to be connected to the first end of the drag strap on the similarly configured garment worn by the individual so as to allow the rescuer to lift the individual from the seated position.

Now turning to FIGS. 15 and 16, second example garments 110 are illustrated for use by both a rescuer R and an individual I to be rescued. Second example garments 110 include several components and features in common with the first example garments 10, but each garment 110 differs with respect to one aspect of the drag strap 22, includes auxiliary straps 132, and differs in the ways one may connect the auxiliary straps 132 on the garment 110 of the rescuer R to the drag strap 22 on the garment 110 of the individual I for increased stability of the individual I, while permitting the rescuer R and individual I to have free hands F during the extraction. For instance, in FIG. 15, the auxiliary straps 132 on the garment 110 of the rescuer R have a first end 136 connected to the torso strap system 19 and a second end 138 that includes a connector 140 that may be connected to the drag strap 22 on the garment 110 of the individual I proximate the first end 24 of the drag strap 22 near the connection of the drag strap 22 to the torso strap system 19. As shown, the drag strap 22 may include connectors 131, similar to the connectors 30 near the second end 25 of the drag strap 22. The connectors 131 may be constructed similarly to connectors 30 which were discussed above with respect to the first example garments 10.

In FIG. 16, the garments 110 are shown in a further connection configuration, where the rescuer R is able to support the individual I above a seated position. A connector 26 on the second end 25 of the drag strap 22 of the garment 110 of the individual I is first connected to a drag strap coupling 21 on the garment 110 of the rescuer R. The rescuer R then extends the auxiliary straps 132 from the rescuer's garment 110 and connects the connectors 140 on the auxiliary straps 132 to the connectors 131 proximate the first end 24 of the drag strap 22 of the garment 110 of the individual I. The rescuer R next stoops down and slides the looped auxiliary straps 132 over the shoulders of the rescuer R. Upon standing, the rescuer R then lifts the individual I to the position shown in FIG. 16, permitting both the rescuer R and individual I to have free hands F during the extraction of the injured individual I.

Figure 17:
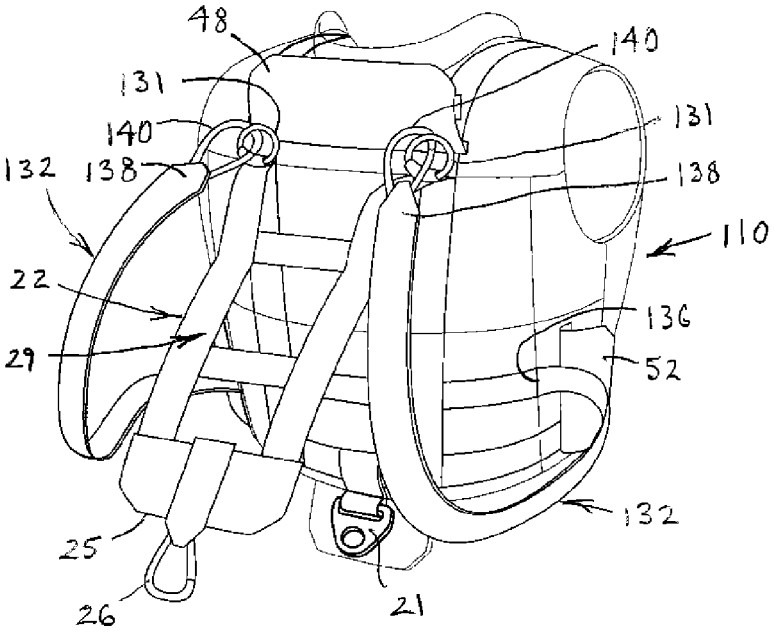
FIG. 17 is a rear perspective view of a garment of the second example shown in FIG. 15, but in a different optional configuration where auxiliary straps extending from the garment of an individual are connected to the drag strap of the same garment, forming a backpack arrangement for the garment worn by the individual permitting the individual to be lifted by a rescuer.
Figure 18:
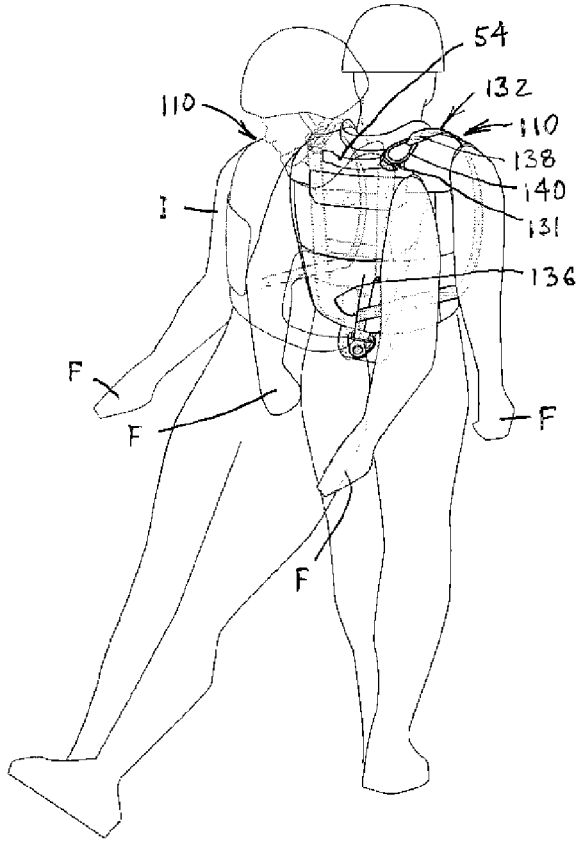
FIG. 18 is a simplified view of a rescuer and an individual wearing garments of the second example with the garment of the individual being in the configuration shown in FIG. 17, and with the rescuer having connected the drag strap of the individual to the drag strap coupling on the rescuer's garment and then slipping the auxiliary straps of the individual over the rescuer's shoulders and standing to lift the individual.

As shown in FIGS. 17 and 18, the second example garment 110 worn by the individual I being rescued may be placed in a configuration that resembles a backpack, for hands free lifting by a rescuer R. The drag strap 22 is extended from the garment of the individual until the connectors 131 are exposed at the first end 24 of the drag strap 22, and the auxiliary straps 132 are extended from the garment of the individual and the connectors 140 at the second end 138 are connected to the respective connectors 131 at the first end of the drag strap 22. This forms the backpack arrangement shown in FIG. 17.

FIG. 18 shows a rescuer R who has manipulated the garment of an individual I to be in the arrangement shown in FIG. 17, and then connected the connector 26 on the second end 25 of the drag strap 22 to the drag strap coupling 21 on the garment 110 of the rescuer R. Finally, the rescuer R has stooped down, slipped the auxiliary straps 132 on the garment 110 of the individual I over the rescuer's shoulders, and then stood up to lift the individual I from the seated position to an more upright position that will reduce the drag effects on the individual I, while permitting both the rescuer R and the individual I to have hands free F to grasp equipment or otherwise help facilitate the extraction of the individual I.

It will be understood that the examples described above are illustrative of some of the applications of the principles of the present subject matter. Thus, while examples were provided and discussed with respect to armored vests, it is contemplated that garments may be constructed for many different applications wherein personnel could don a commonly configured garment having an evacuation harness and have access to many of the above-mentioned advantages. Further additions or alterations may be made to the garments having an evacuation harness or to methods of using such devices, and may be made without departing from the spirit and scope of the present disclosure. Numerous modifications may be made by those skilled in the art without departing from the spirit and scope of the claimed subject matter, including but not limited to combinations of features that are individually disclosed or claimed herein. For these reasons, the scope of this disclosure is not limited to the above examples but is as set forth in the appended claims.

What is claimed is:

1. A garment having an evacuation harness comprising:
an outer wear unit including at least a torso portion; and
an evacuation harness comprising:
- a torso strap system connected to the outer wear unit;
- a drag strap coupling connected to the torso strap system and extending rearward but remaining proximate a lower portion of the outer wear unit; and
- a drag strap connected at a first end to the torso strap system at a position above the drag strap coupling and the drag strap being selectively extendible rearward and upward from an upper portion of the outer wear unit, wherein the rearward and upward extending drag strap includes a head support portion having a width sufficient to stabilize a head when resting on the head support portion.

2. The garment having an evacuation harness of claim 1, wherein the drag strap that is selectively extendible rearward and upward from an upper portion of the outer wear unit includes a second end having a connector that is connectable to a drag strap coupling of a like garment having an evacuation harness.

3. The garment having an evacuation harness of claim 1, wherein the outer wear unit further comprises a rear portion having a flap that releasably covers the drag strap when the drag strap is not extended rearward relative to the outer wear unit.

4. The garment having an evacuation harness of claim 1, wherein the drag strap is stowable within an upper portion of the outer wear unit and extendible through an aperture in the outer wear unit.

5. The garment having an evacuation harness of claim 1, further comprising a handle connected to the torso strap system above the drag strap and located on a rear of the outer wear unit.

6. The garment having an evacuation harness of claim 1, further comprising at least two auxiliary straps connected to the torso strap system and being laterally spaced apart and located proximate the sides of the outer wear unit and at a level below arm holes in the outer wear unit.

7. The garment having an evacuation harness of claim 6, wherein the at least two auxiliary straps are stowable within the outer wear unit and extendible through respective apertures in the outer wear unit.

8. The garment having an evacuation harness of claim 6, wherein the outer wear unit further comprises flaps that releasably cover the auxiliary straps when they are not extended.

9. The garment having an evacuation harness of claim 6, wherein each auxiliary strap further is extendible forward and upward to pass over the outer wear unit and then rearward and has a connector that is connectible to the drag strap on the same garment.

10. The garment having an evacuation harness of claim 6, wherein each auxiliary strap further comprises a first segment that is extendible rearward from the outer wear unit of a forward facing garment and has a connector that is connectible to a drag strap on a rearward facing like garment having an evacuation harness.

11. The garment having an evacuation harness of claim 10, wherein each auxiliary strap further comprises a second segment that is selectively extendible from the first segment and is configured to be grasped by a person wearing the garment.

12. A garment having an evacuation harness comprising:
an outer wear unit including at least a torso portion; and
an evacuation harness comprising:
a torso strap system connected to the outer wear unit;
a drag strap coupling connected to the torso strap system and extending rearward but remaining proximate a lower portion of the outer wear unit;
a drag strap connected to the torso strap system at a position above the drag strap coupling and being selectively extendible rearward and upward from an upper portion of the outer wear unit; and
at least two auxiliary straps connected to the torso strap system and being selectively extendible from the outer wear unit at laterally spaced apart positions located at a level below arm holes in the outer wear unit.

13. The garment having an evacuation harness of claim 12, further comprising flaps on the garment covering respective apertures through which the drag strap and auxiliary straps are extendible.

14. The garment having an evacuation harness of claim 12, wherein each auxiliary strap is extendible from the outer wear unit and has a connector that is connectible to a drag strap on a like garment having an evacuation harness.

15. The garment having an evacuation harness of claim 12, wherein each auxiliary strap is extendible from the outer wear unit and has a connector that is connectible to the drag strap on the same garment.

16. The garment having an evacuation harness of claim 12, further comprising a handle connected to the torso strap system above the drag strap and located on a rear of the outer wear unit.

17. A rescue garment system comprising:
at least two similarly configured garments, each of the garments further comprising:
an outer wear unit including at least a torso portion; and
an evacuation harness comprising:
a torso strap system connected to the outer wear unit;
a drag strap coupling connected to the torso strap system and extending rearward but remaining proximate a lower portion of the outer wear unit; and
a drag strap connected at a first end to the torso strap system at a position above the drag strap coupling and the drag strap having a connector at a second end that is selectively extendible rearward and upward relative to the outer wear unit; and
wherein the connector on the second end of the drag strap of one of the respective at least two garments is removably connectible to the drag strap coupling of the other of the respective at least two garments.

18. The rescue garment system of claim 17, wherein for each of the at least two garments the drag strap includes a head support portion having a width sufficient to stabilize a head when resting on the head support portion.

19. The rescue garment system of claim 17, wherein each of the at least two garments further comprises a handle connected to the torso strap system above the drag strap and located on a rear of the outer wear unit.

20. The rescue garment system of claim 17, wherein each of the at least two garments further comprises at least two auxiliary straps connected to the torso strap system and being laterally spaced apart and located proximate the sides of the outer wear unit and at a level below arm holes in the outer wear unit.

21. The rescue garment system of claim 20, wherein for each of the at least two garments each auxiliary strap has a connector that is connectible to the drag strap of the other of the at least two garments.

22. The rescue garment system of claim 20, wherein for each of the at least two garments each auxiliary strap has a connector that is connectible to the drag strap on the same garment.

23. A method of connecting a rescuer wearing a garment having an evacuation harness to an individual wearing a similarly configured garment having an evacuation harness, wherein each garment having an evacuation harness includes an outer wear unit and an evacuation harness, with the evacuation harness further comprising a torso strap system connected to the outer wear unit, a drag strap coupling connected to the torso strap system and extending rearward relative to the outer wear unit, and a drag strap connected to the torso strap system and being selectively extendible rearward relative to the outer wear unit, the method comprising the steps of:
extending from the garment of the individual the drag strap in a direction rearward relative to the individual; and
connecting the drag strap on the garment of the individual to the drag strap coupling on the garment of the rescuer that extends in a direction rearward relative to the rescuer, wherein the individual faces substantially opposite to a direction of travel of the rescuer.

24. The method of connecting a rescuer wearing a garment having an evacuation harness to an individual wearing a similarly configured garment having an evacuation harness of claim 23, further comprising the step of:

extending the drag strap from a stowed position through an aperture in the outer wear unit of the garment of the individual before connecting the drag strap to the drag strap coupling on the garment of the rescuer.

25. The method of connecting a rescuer wearing a garment having an evacuation harness to an individual wearing a similarly configured garment having an evacuation harness of claim 23, further comprising the steps of:

providing for each of the respective garments at least two auxiliary straps connected to the torso strap system of the respective garment; and connecting the auxiliary straps on the garment of the rescuer to the drag strap on the garment of the individual or connecting the auxiliary straps on the garment of the individual to the drag strap on the garment of the individual to provide a backpack configuration for at least partially lifting the individual.

26. The method of connecting a rescuer wearing a garment having an evacuation harness to an individual wearing a similarly configured garment having an evacuation harness of claim 25, wherein each of the auxiliary straps further comprises a first segment that extends between the torso strap system on the garment of the rescuer and the drag strap on the garment of the individual and a second segment that has a first end connected to the first segment and that is further releasably connected along its length to the first segment, further comprising the steps of:

releasing along their length the connection between the respective first and second segments of each auxiliary strap on the garment of the rescuer while maintaining the connection of the first end of the second segment to the first segment; and having the rescuer grasp and pull a second end of each respective second segment of the auxiliary straps on the garment of the rescuer thereby partially lifting the individual.

27. The method of connecting a rescuer wearing a garment having an evacuation harness to an individual wearing a similarly configured garment having an evacuation harness of claim 25, wherein the at least two auxiliary straps are stowable within the outer wear unit and extendible through respective apertures in the outer wear unit and the outer wear unit further comprises flaps that releasably cover the auxiliary straps when they are not extended.

28. A garment having an evacuation harness comprising:

an outer wear unit including at least a torso portion; and an evacuation harness comprising:

a torso strap system connected to the outer wear unit;

a drag strap coupling connected to the torso strap system and extending rearward but remaining proximate a lower portion of the outer wear unit;

a drag strap connected at a first end to the torso strap system at a position above the drag strap coupling and the drag strap being selectively extendible rearward and upward from an upper portion of the outer wear unit; and further comprising a handle connected to the torso strap system above the drag strap and located on a rear of the outer wear unit.

* * * * *